US010730678B2

(12) United States Patent
Huffer

(10) Patent No.: US 10,730,678 B2
(45) Date of Patent: Aug. 4, 2020

(54) MONO-WEB PACKAGE WITH TAMPER-EVIDENT TEAR STRIP AND RESEALABLE FLAP PORTION

(71) Applicant: Sonoco Development, Inc., Hartsville, SC (US)

(72) Inventor: Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/150,799

(22) Filed: May 10, 2016

(65) Prior Publication Data

US 2017/0327289 A1 Nov. 16, 2017

(51) Int. Cl.
*B65D 33/20* (2006.01)
*B65D 33/34* (2006.01)
(Continued)

(52) U.S. Cl.
CPC ..... *B65D 75/5844* (2013.01); *B65D 33/20* (2013.01); *B65D 65/10* (2013.01);
(Continued)

(58) Field of Classification Search
CPC B65D 75/58; B65D 75/5827; B65D 75/5833; B65D 75/5838; B65D 75/5844;
(Continued)

(56) References Cited

U.S. PATENT DOCUMENTS 3,338,019 A 8/1967 Trewella et al.
3,613,874 A 10/1971 Miller
(Continued)

FOREIGN PATENT DOCUMENTS

CA 1 265 104 A1 1/1990
DE 79 12 210 U1 10/1979
(Continued)

OTHER PUBLICATIONS

International Search Report and Written Opinion for Application No. PCT/US2014/021551 dated Jun. 16, 2014.
(Continued)

*Primary Examiner* — Jes F Pascua
*Assistant Examiner* — Nina K Attel
(74) *Attorney, Agent, or Firm* — Nelson, Mullins, Rilley & Scarborough LLP

(57) ABSTRACT

A package and method of making a package are provided, where the package includes a removable flap portion built into one panel and a resealable flap portion built into the opposing panel. The package is constructed such that the removable flap portion overlies the resealable flap portion, and peeling away of the removable flap portion reveals a pressure sensitive adhesive (PSA) of the resealable flap portion and also provides a tamper-evident feature. Once the removable flap portion is peeled away, the consumer can access the contents of the package. The resealable flap portion can be folded over the newly-cut edge of the opposing panel and applied to the outer surface of that panel so as to reclose the package and maintain the contents of the package therein for later consumption.

16 Claims, 13 Drawing Sheets

(51) Int. Cl.

| | |
|---|---|
| ***B65D 75/58*** | (2006.01) |
| ***B65D 65/10*** | (2006.01) |
| ***B65D 65/14*** | (2006.01) |
| ***B65D 75/26*** | (2006.01) |
| ***B65D 75/30*** | (2006.01) |

(52) U.S. Cl.
CPC ..... *B65D 65/14* (2013.01); *B65D 75/26* (2013.01); *B65D 75/30* (2013.01); *B65D 75/5833* (2013.01); *B65D 75/5855* (2013.01); *B65D 2575/586* (2013.01)

(58) Field of Classification Search
CPC ..... B65D 75/5855; B65D 75/5805; B65D 75/5811; B65D 33/18; B65D 33/20; B65D 33/34; B65D 2575/586
USPC ..... 383/200, 61.1, 203–211, 93–95, 97, 5
See application file for complete search history.

(56) References Cited

U.S. PATENT DOCUMENTS

| | | | | |
|---|---|---|---|---|
| 4,572,377 | A | 2/1986 | Beckett | |
| 4,650,079 | A | 3/1987 | Tani | |
| 4,785,940 | A | 11/1988 | Wilson | |
| 4,923,309 | A | 5/1990 | Van Erden | |
| 4,941,196 | A | 7/1990 | Edelman et al. | |
| 4,961,503 | A | 10/1990 | Bell | |
| 5,118,203 | A | 6/1992 | Andronico | |
| 5,456,928 | A | 10/1995 | Hustad et al. | |
| 5,873,456 | A * | 2/1999 | Hull | H01H 9/0242 206/305 |
| 5,882,749 | A | 3/1999 | Jones et al. | |
| 5,945,146 | A | 8/1999 | Twinam | |
| 5,954,431 | A | 9/1999 | Fabel | |
| 6,461,044 | B1 | 10/2002 | Anderson | |
| 6,502,986 | B1 | 1/2003 | Bensur et al. | |
| 6,610,338 | B2 | 8/2003 | Tang | |
| 6,743,451 | B2 | 6/2004 | Rasile et al. | |
| 7,341,160 | B2 | 3/2008 | Cappel et al. | |
| 7,404,488 | B2 | 7/2008 | Verbruggen et al. | |
| 7,491,433 | B2 | 2/2009 | Bletsos et al. | |
| 7,563,027 | B2 | 7/2009 | Allen et al. | |
| 7,744,517 | B2 | 6/2010 | Bonenfant | |
| 7,806,594 | B2 | 10/2010 | Trinko | |
| 8,167,487 | B2 | 5/2012 | Fuller | |
| 8,398,306 | B2 | 3/2013 | Kinigakis et al. | |
| 8,646,975 | B2 | 2/2014 | Moehlenbrock et al. | |
| 8,746,490 | B2 | 6/2014 | Huffer et al. | |
| 8,944,250 | B2 | 2/2015 | Huffer | |
| 2007/0104395 | A1 | 5/2007 | Kinigakis et al. | |
| 2007/0205127 | A1 | 9/2007 | Barndt et al. | |
| 2009/0022431 | A1 | 1/2009 | Conner | |
| 2010/0247003 | A1 | 9/2010 | Huffer et al. | |
| 2010/0276323 | A1 | 11/2010 | Grossman | |
| 2011/0038569 | A1 | 2/2011 | Huffer et al. | |
| 2011/0235947 | A1 | 9/2011 | Austreng et al. | |
| 2012/0195531 | A1* | 8/2012 | Moehlenbrock | B31B 19/90 383/109 |
| 2012/0207412 | A1* | 8/2012 | Moehlenbrock | B31B 1/00 383/105 |
| 2013/0026170 | A1 | 1/2013 | Zerfas et al. | |
| 2013/0077894 | A1* | 3/2013 | Tseng | B65D 33/20 383/42 |
| 2013/0089280 | A1 | 4/2013 | Tseng et al. | |
| 2013/0153445 | A1 | 6/2013 | Cullison | |
| 2014/0251849 | A1* | 9/2014 | Huffer | B65D 75/5855 206/454 |
| 2014/0270584 | A1 | 9/2014 | Exner et al. | |
| 2017/0088313 | A1* | 3/2017 | Tracy | B65D 33/20 |

FOREIGN PATENT DOCUMENTS

| | | | |
|---|---|---|---|
| GB | 2 325 449 | A | 11/1998 |
| WO | WO 99/64308 | A1 | 12/1999 |
| WO | WO-03/066240 | A2 | 8/2003 |
| WO | WO 2010/110372 | | 9/2010 |
| WO | WO 2015/178882 | | 11/2015 |
| WO | WO 2015/178882 | A1 | 11/2015 |

OTHER PUBLICATIONS

International Preliminary Report on Patentability and Written Opinion for PCT/IB2017/052705 dated Nov. 22, 2018.

International Search Report and Written Opinion for International Patent Application No. PCT/IB2017/052705, dated Jul. 7, 2017, 14 pages.

Office Action from European Patent Application No. 14712975.3 dated Sep. 30, 2016, 4 pages.

Office Action from Canadian Patent Application No. 2,904,886, dated Jul. 5, 2016, 4 pages.

Notice of Allowance from Canadian Patent Application No. 2,904,886, dated Feb. 28, 2017, 1 page.

Canadian Patent Application No. 3,021,272, filed Oct. 17, 2018, Canadian Office Action dated Apr. 30, 2020.

* cited by examiner

MONO-WEB PACKAGE WITH TAMPER-EVIDENT TEAR STRIP AND RESEALABLE FLAP PORTION

BACKGROUND OF THE INVENTION

The present disclosure relates in general to packaging for products, and more particularly to packaging constructed from flexible film-based materials. In particular, packages are described that can be made using horizontal form-fill-seal (HFFS) or vertical form-fill-seal (VFFS) processes and include a tamper-evident tear strip that, when removed, reveals a resealable flap portion that can be used to reclose the package after the initial opening.

Flexible film-based materials are commonly employed for constructing packages for products that are perishable, such as food products that must be protected against oxygen exposure and must be prevented from either drying out (in the case of moist products such as cheese, or wet wipes) or from picking up moisture from the outside environment (in the case of dry products such as crackers or cookies). If the product is of the type that will be used little by little over time, then it is desirable to provide a way to reclose the package after it is opened for the first time, so that the remaining product in the package is still protected against continual oxygen infiltration and moisture vapor transmission. Various configurations of film-based packages that are reclosable have been developed. Further improvements in such packages are desired.

BRIEF SUMMARY

Embodiments of the invention provide a package and method of making a package, where the package comprises a sheet that is folded to define two opposing panels. The package includes a removable flap portion built into one panel and a resealable flap portion built into the opposing panel. The package is constructed such that the removable flap portion overlies the resealable flap portion, and peeling away of the removable flap portion reveals a pressure sensitive adhesive (PSA) of the resealable flap portion. In this way, the resealable flap portion can be folded over the newly-cut edge of the opposing panel and applied to the outer surface of that panel so as to reclose the package and maintain the contents of the package therein.

In some embodiments, for example, a package for holding a product is provided that comprises a sheet of material. The sheet defines a first panel having an outer surface and an opposite, product-facing inner surface. The first panel extends between a top edge and a folded edge forming an opposite bottom edge each extending in a transverse direction, and two opposing side edges each extending in a perpendicular longitudinal direction, between the top and bottom edges. The sheet also defines a second panel having an outer surface and an opposite, product-facing inner surface. The second panel extends between a top edge and the folded edge forming an opposite bottom edge each extending in a transverse direction, and two opposing side edges each extending in a perpendicular longitudinal direction, between the top and bottom edges. The package further comprises a layered structure formed on a first region of the inner surface of the first panel proximate the top edge thereof and extending substantially from one of the side edges to the other of the side edges. The layered structure comprises a pressure-sensitive adhesive (PSA) disposed on the first region of the first panel, and a non-tacky sealant coating disposed over and covering the PSA such that the PSA is not exposed as long as the sealant coating is in place. The first panel and the second panel are disposed such that the respective inner surfaces face each other and the respective side and top edges are substantially aligned, wherein side seals are formed along at least the two pairs of opposing side edges of the first and second panels, such that a product placed between the first and second panels is enveloped thereby. The second panel comprises a sealant material disposed on the inner surface thereof at least in a second region corresponding to the first region of the first panel. The second panel further comprises at least one line of weakness defining a removable flap portion comprising the second region and overlying the first region of the first panel. In addition, a permanent seal between the first and second panels in an area of the first and second regions has a bond strength exceeding that existing between the sealant coating and the PSA, such that peeling back the removable flap portion causes the sealant coating to be lifted from the PSA and thereby exposes the PSA, creating a resealing flap portion of the first panel that is configured to be folded over a new top edge of the second panel for resealing the package.

In some cases, the sealant coating may comprise a polyethylene (PE) emulsion. The removable flap portion may be defined by a lower line of weakness and an upper line of weakness. The at least one line of weakness may, in some embodiments, comprise a laser score line that extends partially through a thickness of the second panel. In other embodiments, the at least one line of weakness may comprise a perforation that extends from the outer surface of the second panel to the inner surface of the second panel. In such cases, the package may further comprise an inner reseal area defined on at least one of the inner surface of the first panel or the inner surface of the second panel between the folded bottom edge and a location of the at least one line of weakness, such that the inner reseal area, when sealed, is configured to maintain an integrity of the package interior prior to peeling of the removable flap portion. The inner reseal area may comprise at least one strip of PSA.

In some cases, at least one of the first or second panels may comprise a mono-web, olefin-based film. Additionally or alternatively, the first and second panels may comprise a barrier layer.

In other embodiments, a method of making a package from a sheet of material is provided that includes forming a first panel having an outer surface and an opposite, product-facing inner surface, the first panel extending between a top edge and an opposite folded bottom edge each extending in a transverse direction, and two opposing side edges each extending in a perpendicular longitudinal direction, between the top and bottom edges; forming a second panel having an outer surface and an opposite, product-facing inner surface, the second panel extending between a top edge and the opposite folded bottom edge each extending in a transverse direction, and two opposing side edges each extending in a perpendicular longitudinal direction, between the top and bottom edges; forming a layered structure on a first region of the inner surface of the first panel proximate the top edge thereof and extending substantially from one of the side edges to the other of the side edges, the layered structure comprising a pressure-sensitive adhesive (PSA) disposed on the first region of the first panel, and a non-tacky sealant coating disposed over and covering the PSA such that the PSA is not exposed as long as the sealant coating is in place; and disposing a sealant material on the inner surface of the second panel at least in a second region corresponding to the first region of the first panel. At least one line of weakness may be formed to define a removable flap portion comprising the second region, and the first panel may be sealed to the second panel, such that the first panel and the second panel are disposed with respective inner surfaces facing each other and the respective side and top edges being substantially aligned. Side seals may be formed along at least the two pairs of opposing side edges of the first and second panels, such that a product placed between the first and second panels is enveloped thereby and the second region of the second panel overlies the first region of the first panel. In addition, a permanent seal may be applied between the first and second panels in an area of the first and second regions, wherein the permanent seal has a bond strength exceeding that existing between the sealant coating and the PSA, such that peeling back the removable flap portion causes the sealant coating to be lifted from the PSA and thereby exposes the PSA, creating a resealing flap portion of the first panel that is configured to be folded over a new top edge of the second panel for resealing the package.

In some embodiments, the sealant coating may comprise a polyethylene (PE) emulsion. Forming the at least one line of weakness to define the removable flap portion may comprise forming a lower line of weakness and an upper line of weakness, wherein the removable flap portion is defined therebetween. Additionally or alternatively, forming the at least one line of weakness to define the removable flap portion may comprise laser scoring the second panel to form a laser score line that extends partially through a thickness of the second panel. Forming the at least one line of weakness to define the removable flap portion may comprise creating a perforation that extends from the outer surface of the second panel to the inner surface of the second panel.

In some cases, the method may further comprise defining an inner reseal area on at least one of the inner surface of the first panel or the inner surface of the second panel between the respective bottom edge and a location of the at least one line of weakness, such that the inner reseal area, when sealed, is configured to maintain an integrity of the package interior prior to peeling of the removable flap portion. Defining the inner reseal area may comprise applying at least one strip of PSA to at least one of the inner surface of the first panel or the inner surface of the second panel.

At least one of the first or second panels may comprise a mono-web, olefin-based film. The first and second panels may comprise a barrier layer. In some cases, the method may further comprise creating an area of separation between the first panel and the second panel along opposing side edges of at least one of the pairs of opposing side edges in a location of the removable flap portion to facilitate peeling of the removable flap portion. The area of separation may, in some cases, be created using a pattern heat seal tool.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1A:
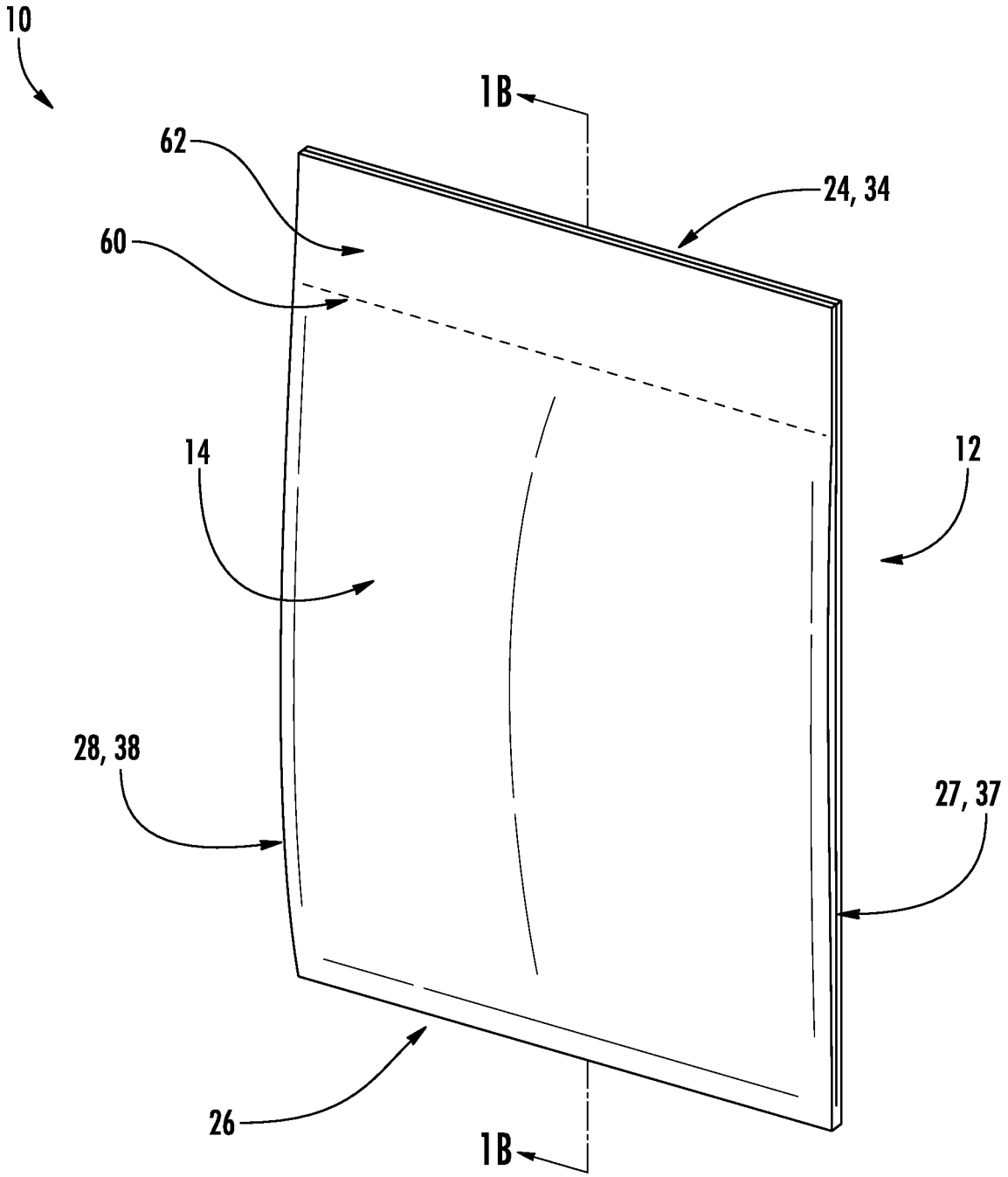
FIG. 1A is a perspective view of a package in a closed configuration according to an example embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, the terms "front," "rear," "top," "bottom," and the like are used for the purposes of explanation as relative terms, only. Thus, a component or part of a component that is referred to as being at the "top" of a structure may be referred to as be being at the "bottom" of the structure, depending on the orientation of the structure.

In some conventional horizontal form-fill-seal (HFFS) and vertical form-fill-seal (VFFS) packaging, a package may be formed for holding contents therein by folding a sheet of material to define a front panel and a rear panel; applying a permanent seal longitudinally to the two side edges of the sheets; filling the package with product via the opening between the top edges of the two sheets; then applying a permanent seal to the top edges to close the package with the contents therein.

Such packages are typically opened by the consumer by tearing the package (e.g., with one's fingers or a sharp object such as scissors) or attempting to separate the panels at one of the seals by pulling apart the panels, either of which can result in consumer frustration over a lack of control of the process, inability to get the package open, or loss of product as the package is opened suddenly and in an unintended manner, resulting in product from within the package spilling out.

Moreover, conventional packages may hold more product than can be used by the consumer at one sitting. In the case of packages of snack foods, such as nuts or candies, for example, the consumer may desire to save an unused portion of the product for consumption at a later time. The consumer may wish to avoid transferring the product to another container, and at the same time may want to retain as much of the freshness of the product as possible within the original packaging.

Through applied effort, ingenuity, and innovation, many of these identified problems have been solved by the inventor. In particular, embodiments of the invention described herein provide a package that can be made using HFFS or VFFS processes, but provides a removable flap portion built-in to one of the panels of material that, when peel off by the consumer, reveals a reseal flap portion built-in to the opposing panel. In this way, the consumer can open the package in a controlled manner to access the product and thereafter reseal the package to save any unused contents for later consumption. The removal of the removable flap portion also serves as a tamper-evident feature, alerting would-be consumers of the package of previous access to the package contents by others.

Figure 1B:
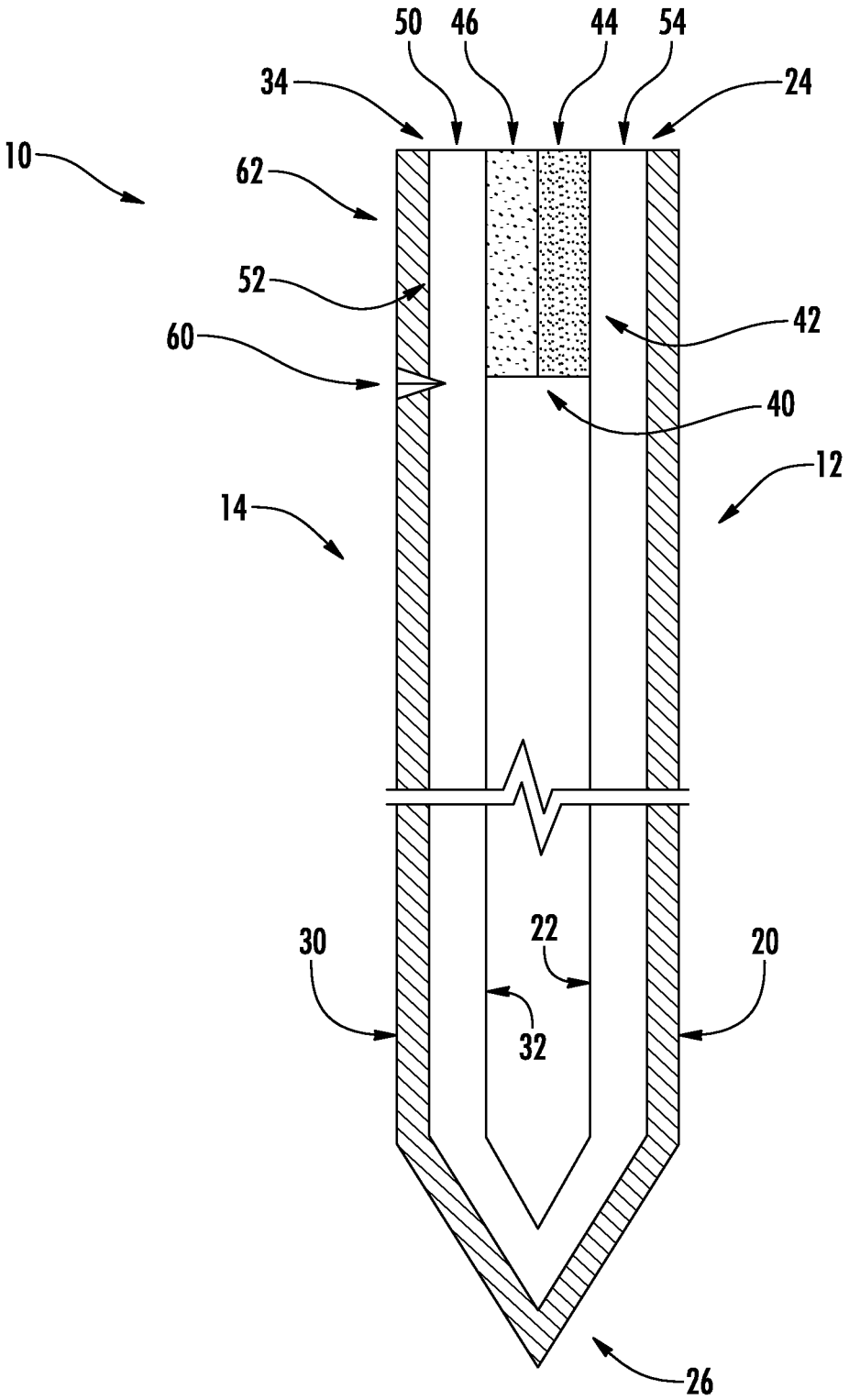
FIG. 1B is an enlarged schematic cross-sectional view of the package of FIG. 1A in a closed configuration according to an example embodiment of the invention.

Turning now to FIGS. 1A and 1B, a package 10 for holding a product is illustrated according to an example embodiment of the invention. The package 10 includes a first panel 12 and a second panel 14 that are formed by folding a sheet of material and sealing the side edges of the panels to each other as shown and described below so as to envelop a product, thereby holding the product within a compartment created between the two panels.

With reference to FIG. 1B, for example, the first panel 12 may have an outer surface 20 and an opposite, product-facing inner surface 22. The first panel 12 may extend between a top edge 24 and a folded edge 26 forming an opposite bottom edge each extending in a transverse direction, and two opposing side edges 27, 28 each extending in a perpendicular longitudinal direction between the top and bottom edges. Likewise, the second panel 14 may have an outer surface 30 and an opposite, product-facing inner surface 32. The second panel 14 may extend between a top edge 34 and the folded edge 26 forming the opposite bottom edge each extending in a transverse direction, and two opposing side edges 37, 38 each extending in a perpendicular longitudinal direction between the top and bottom edges.

The package 10 may further include a layered structure 40 formed on a first region 42 of the inner surface 22 of the first panel 12 proximate the top edge 24 of the first panel and extending substantially from one of the side edges 27 to the other of the side edges 28. The layered structure 40 may comprise a pressure-sensitive adhesive (PSA) 44 disposed on the first region 42 of the first panel 12 and a non-tacky sealant coating 46 disposed over and covering the PSA 44 such that the PSA is not exposed as long as the sealant coating 46 is in place. The sealant coating 46 may be any suitable material that can be pattern-applied and that will form good heat seals. Examples of suitable materials for the sealant coating 46 include polyethylene (PE) emulsion, acrylic, urethane, ethyl vinyl acetate, and the like.

As shown in FIG. 1B, the first panel 12 and the second panel 14 are disposed such that the respective inner surfaces 22, 32 face each other and the respective side 27, 37, 28, 38, and top 24, 34 edges are substantially aligned. Side seals may thus be formed along at least the two pairs of opposing side edges 27, 37, 28, 38 of the first and second panels 12, 14, such that a product placed between the first and second panels is enveloped thereby. At the same time, the second panel 14 may comprise a sealant material 50 disposed on the inner surface 32 of the second panel at least in a second region 52 corresponding to the first region 42 of the first panel 12. In some cases, such as in the depicted embodiment, the sealant material 50 may cover an area that is larger than the area on which the PSA 44 and the sealant coating 46 is disposed, such that the total coverage area of the sealant material 50 is larger than the second region 52 and includes the second region. Moreover, in some embodiments, the first panel 12 may also include a sealant material 54 that is applied to the inner surface 22 of the first panel 12, as shown in FIG. 1B, such that the PSA 44 and the sealant coating 46 are disposed on an inner surface of the sealant material 54.

The sealant materials 54, 50 applied to the first panel 12 and/or the second panel 14 may comprise any of various materials suitable for forming heat seals with high peel strength so that they are essentially permanent seals. Examples of suitable sealant materials 50, 54 may, for example, include polypropylene, polyethylene (HDPE, LDPE, LLDPE), polyethylene terephthalate (PET), nylon, and the like. In some embodiments, for example, one or both of the first and second panels 12, 14 may be made of polyethylene terephthalate (PET) material. In such cases, the sealant material 54 applied to the first panel 12 and/or the sealant material 50 applied to the second panel 14 may be a polyethylene (PE) sealant, and the sealant coating 46 may comprise a PE emulsion.

With continued reference to FIGS. 1A and 1B, the second panel 14 may include at least one line of weakness 60. The line(s) of weakness 60 can be formed in any suitable manner, such as by mechanical cutting, scoring, perforating, or using a laser. In some embodiments, the line of weakness 60 may be a laser score line that extends partially through a thickness of the second panel 14 in some cases or a perforation that extends from the outer surface 30 of the second panel 14 to the inner surface 32 of the second panel in other cases. The at least one line of weakness 60 may thus define a removable flap portion 62. The removable flap portion 62, as shown, may include the second region 52 (e.g., may define at least one boundary of the area covered by the second region) and may overlie the first region 42 of the first panel 12.

Figure 2A:
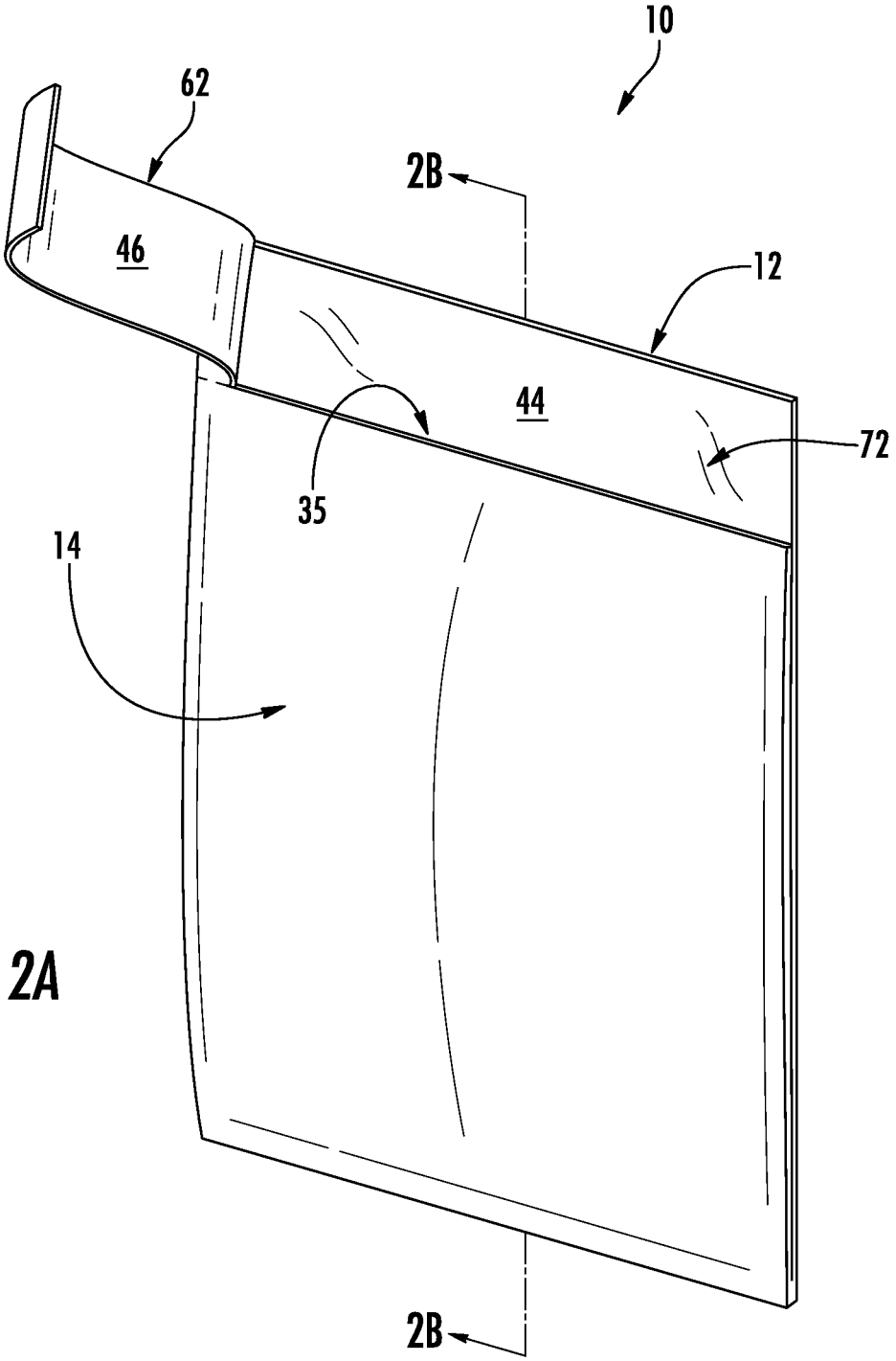
FIG. 2A is a perspective view of a package in a semi-open configuration according to an example embodiment of the invention.
Figure 2B:
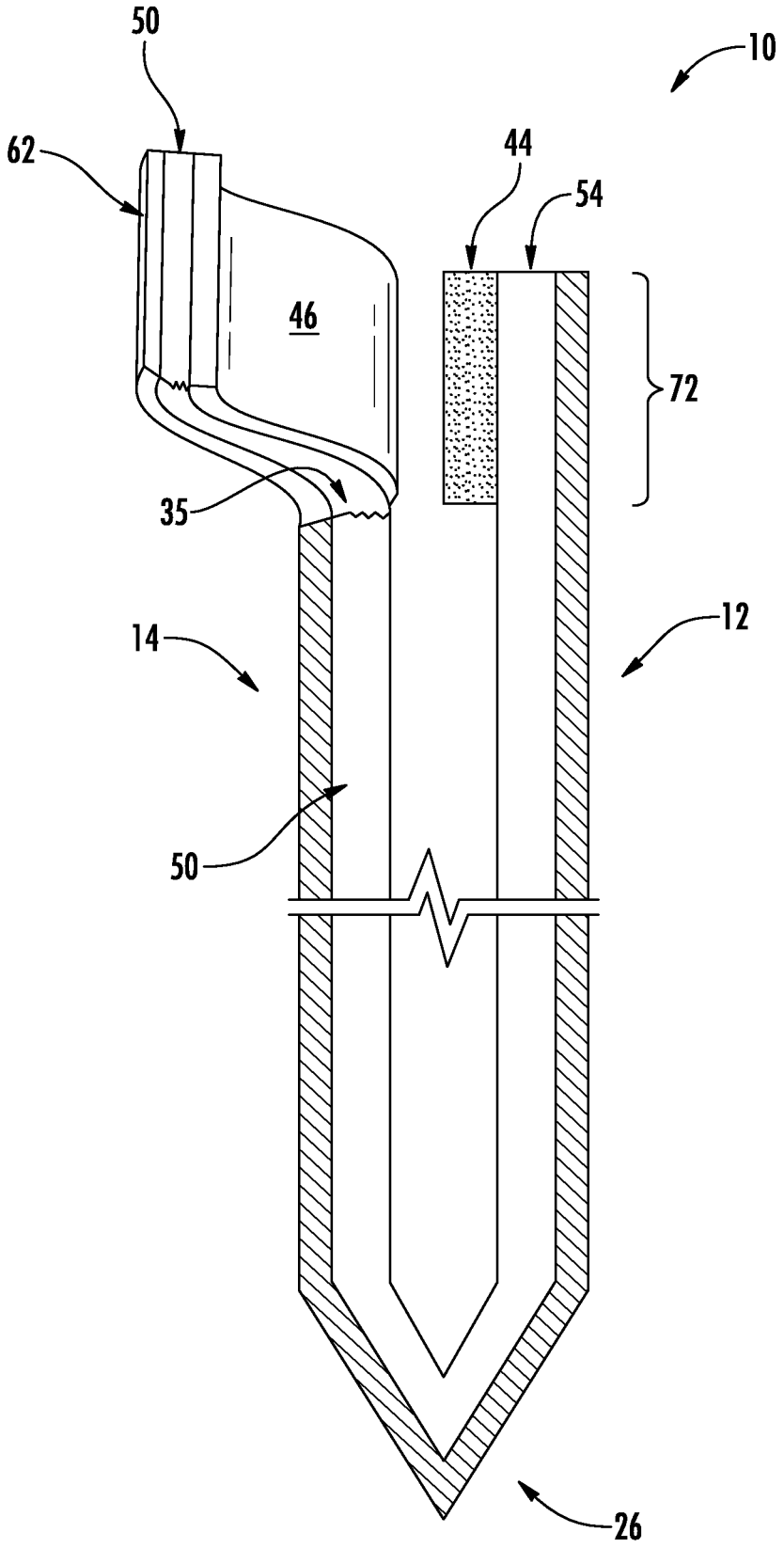
FIG. 2B is an enlarged schematic cross-sectional view of the package of FIG. 2A in a semi-open configuration according to an example embodiment of the invention.
Figure 3A:
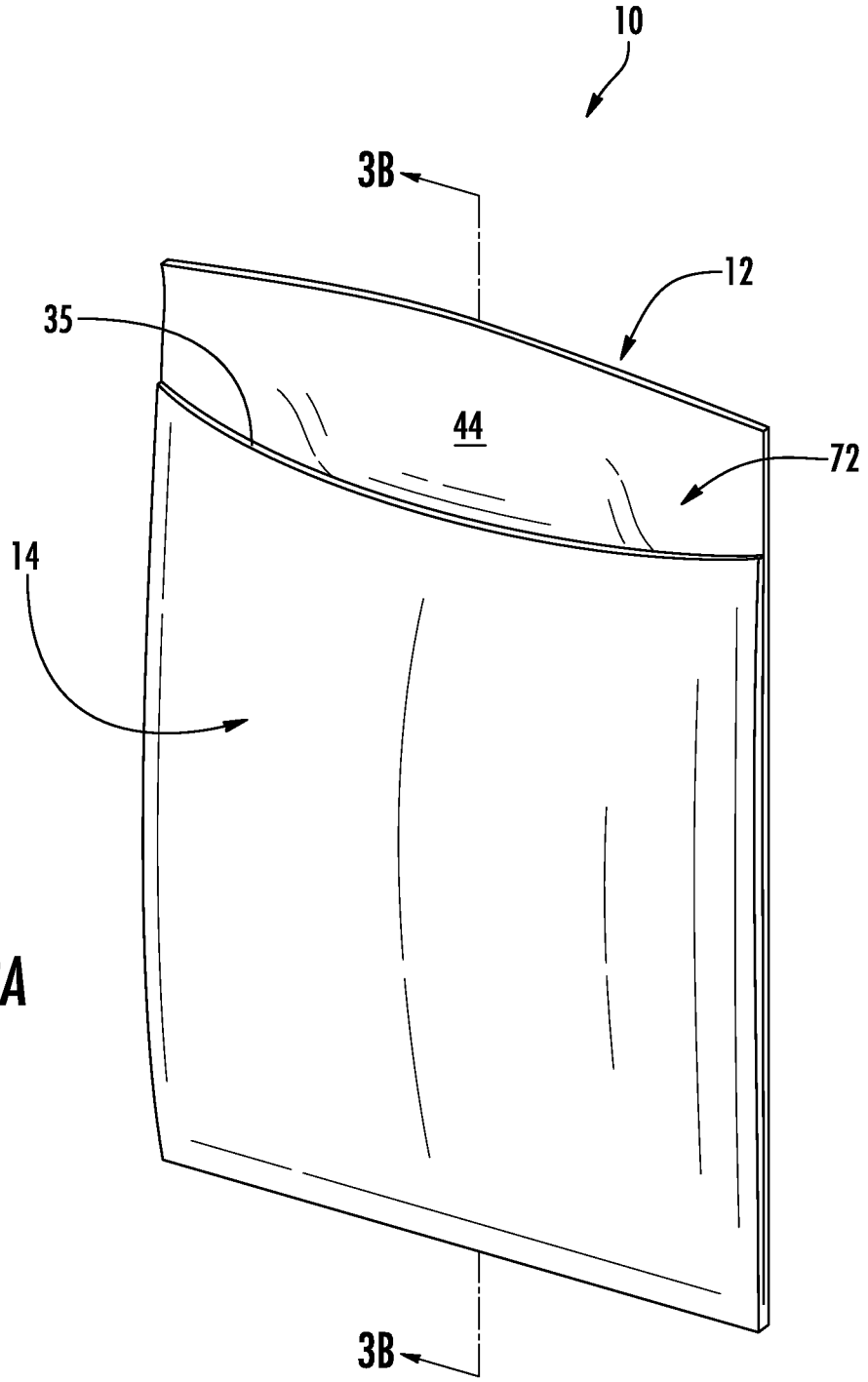
FIG. 3A is a perspective view of a package in an open configuration according to an example embodiment of the invention.
Figure 3B:
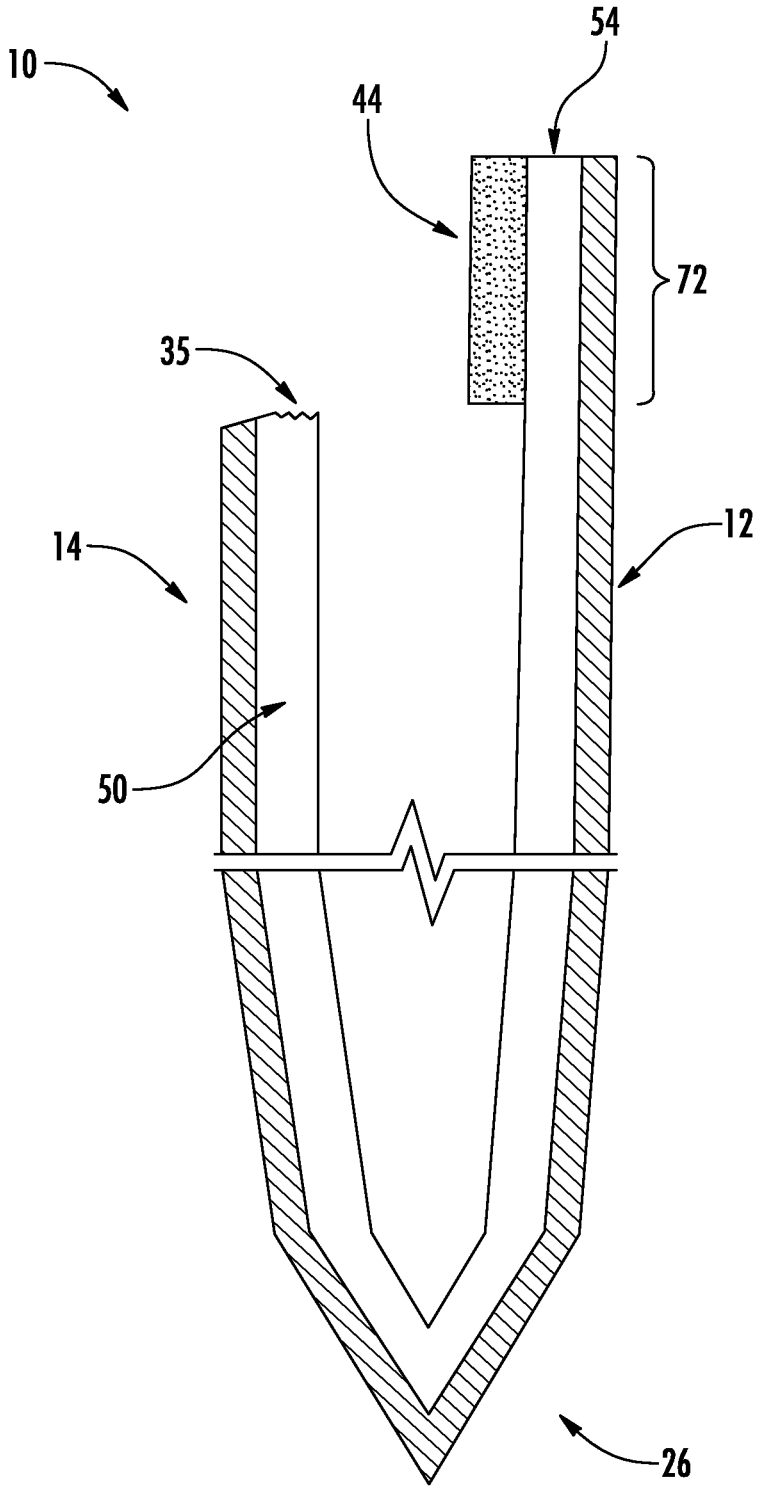
FIG. 3B is an enlarged schematic cross-sectional view of the package of FIG. 3A in an open configuration according to an example embodiment of the invention.

A permanent seal formed between the first and second panels 12, 14 in an area of the first and second regions 42, 52 may thus have a bond strength exceeding that existing between the sealant coating 46 and the PSA 44, such that peeling back the removable flap portion 62 (as shown in FIGS. 2A and 2B) may cause the sealant coating 46 to be lifted from the PSA 44 and thereby expose the PSA 44 when the package is in an open configuration (as shown in FIGS. 3A and 3B), creating a resealing flap portion 72 of the first panel 12 that can be used to reseal the package. Additionally, the necessity of peeling of the removable flap portion 62 in order to gain access to the product held inside the package 10 effectively provides a tamper-evidence feature. Once the removable flap portion 62 is removed, that fact will be readily apparent from a casual visual inspection of the package 10.

Figure 4A:
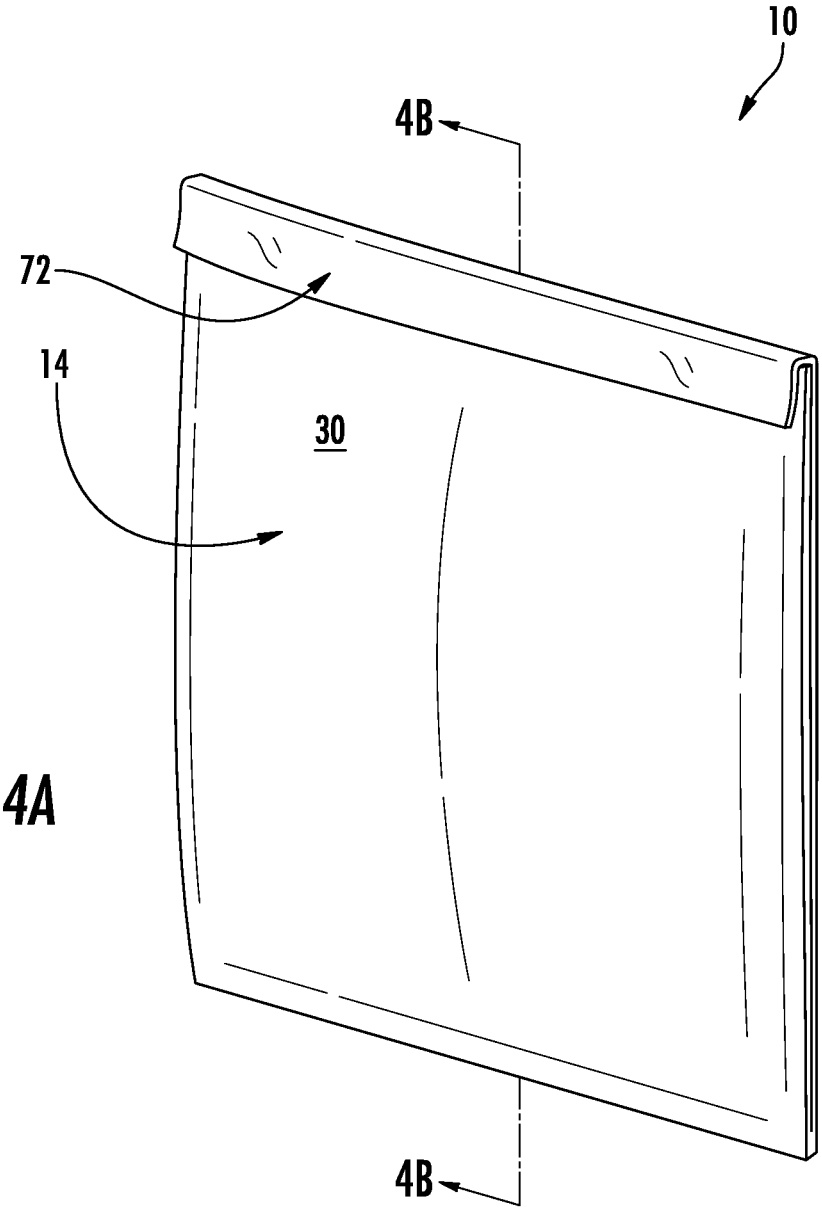
FIG. 4A is a perspective view of a package in a re-sealed configuration according to an example embodiment of the invention.
Figure 4B:
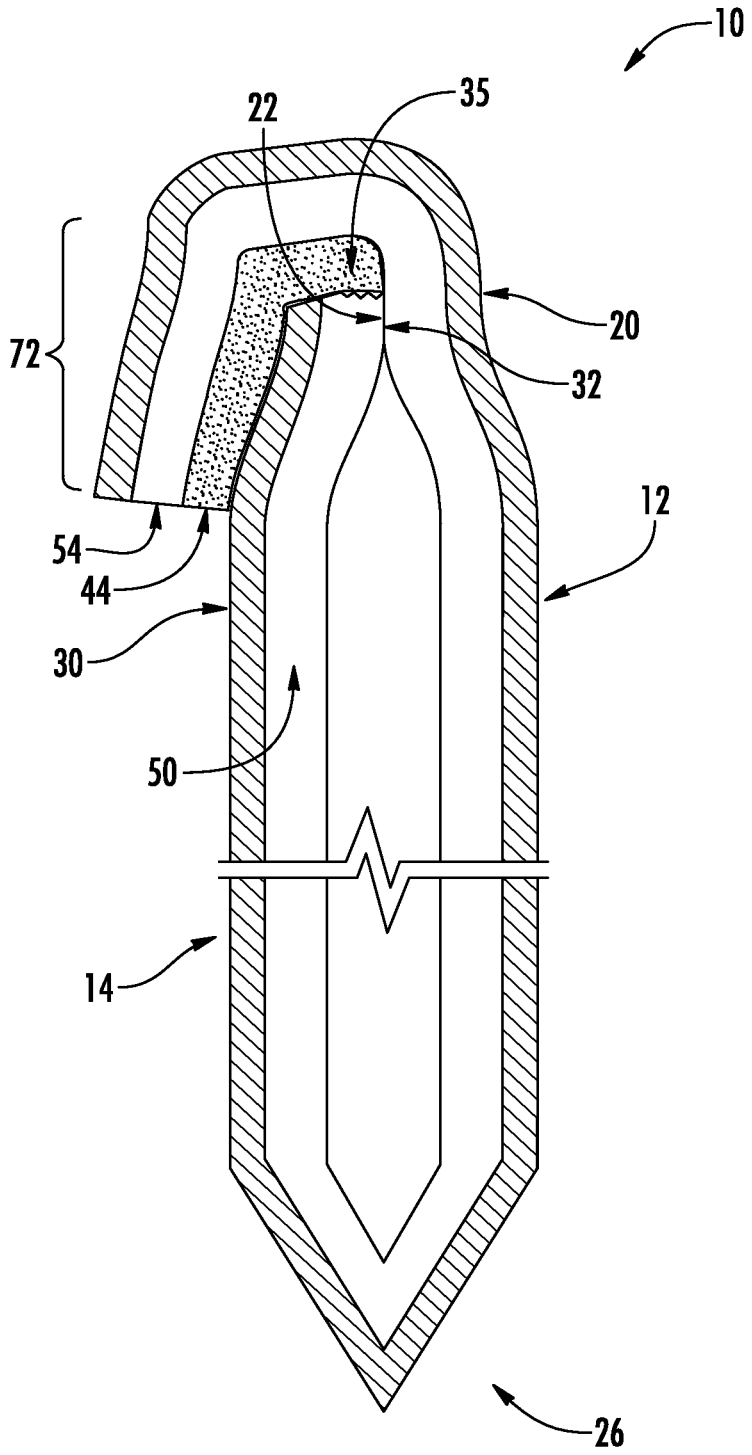
FIG. 4B is an enlarged schematic cross-sectional view of the package of FIG. 4A in a re-sealed configuration according to an example embodiment of the invention.

With reference to FIGS. 4A and 4B, for example, the resealing flap portion 72 may be configured to be folded over a new top edge 35 of the second panel 14 for resealing the package, as shown. Said differently, by peeling away the removable flap portion 62 of the second panel 14, the sealant coating 46 that was initially covering the PSA 44 of the layered structure 40 formed on the inner surface 22 of the first panel 12 is peeled away with the removable flap portion 62, such that the inner surface of the first panel 12 in the first region 42 has now become the PSA 44, as shown in FIGS. 2A-3B. When the resealing flap portion 72 of the first panel 12 is then folded over the new top edge 35 of the second panel 14, the PSA 44 is able to engage the outer surface 30 of the second panel 14 along the new top edge, thus resealing the package 10 as shown in FIGS. 4A and 4B. The removable flap portion 62 may, in some cases, be discarded.

In some embodiments, at least one of the first or second panels 12, 14 may comprise a mono-web, olefin-based film. Moreover, the sheet forming the first and second panels 12, 14 may, in some cases, comprise a barrier layer. The barrier layer may provide a barrier to the passage of oxygen and moisture vapor through the packaging, such that the product inside the package is protected against infiltration of oxygen (which leads to more-rapid product spoilage) and so that moisture in the product (in the case of a moist product such a cheese) is prevented from escaping through the package material (which leads to more-rapid drying out of the product). Examples of suitable barrier materials include ethylene vinyl alcohol copolymer (EVOH), polyvinylidene chloride (PVDC), polyvinyl alcohol (PVOH), aluminum oxide coated PET (ALOx), nanocoated materials, metallized PET, metallized OPP, and the like. In the case of a mono-web film, for example, the barrier material may be layered into the center of the coextruded film.

Figure 5A:
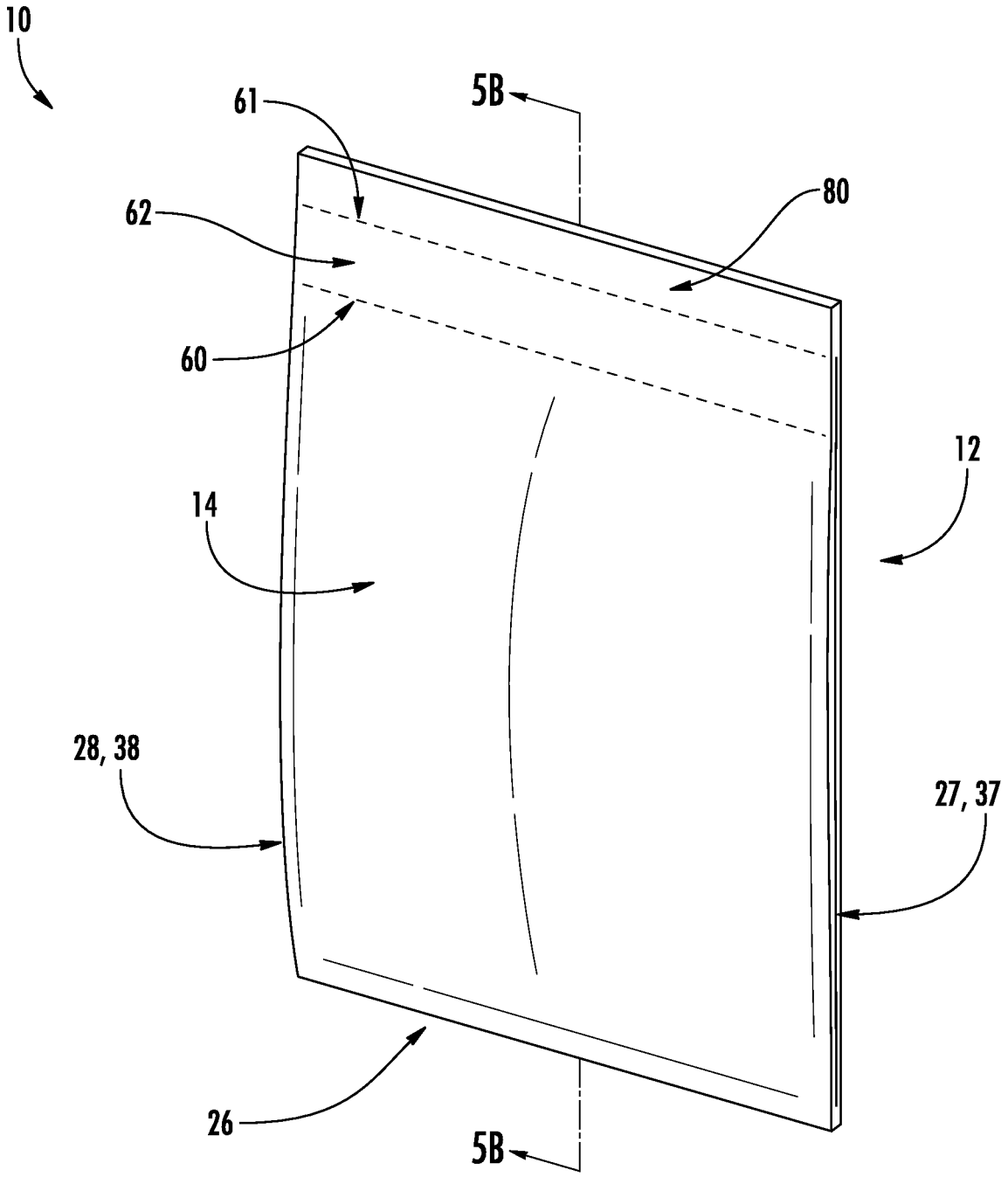
FIG. 5A is a perspective view of a package in a closed configuration according to another example embodiment of the invention.
Figure 5B:
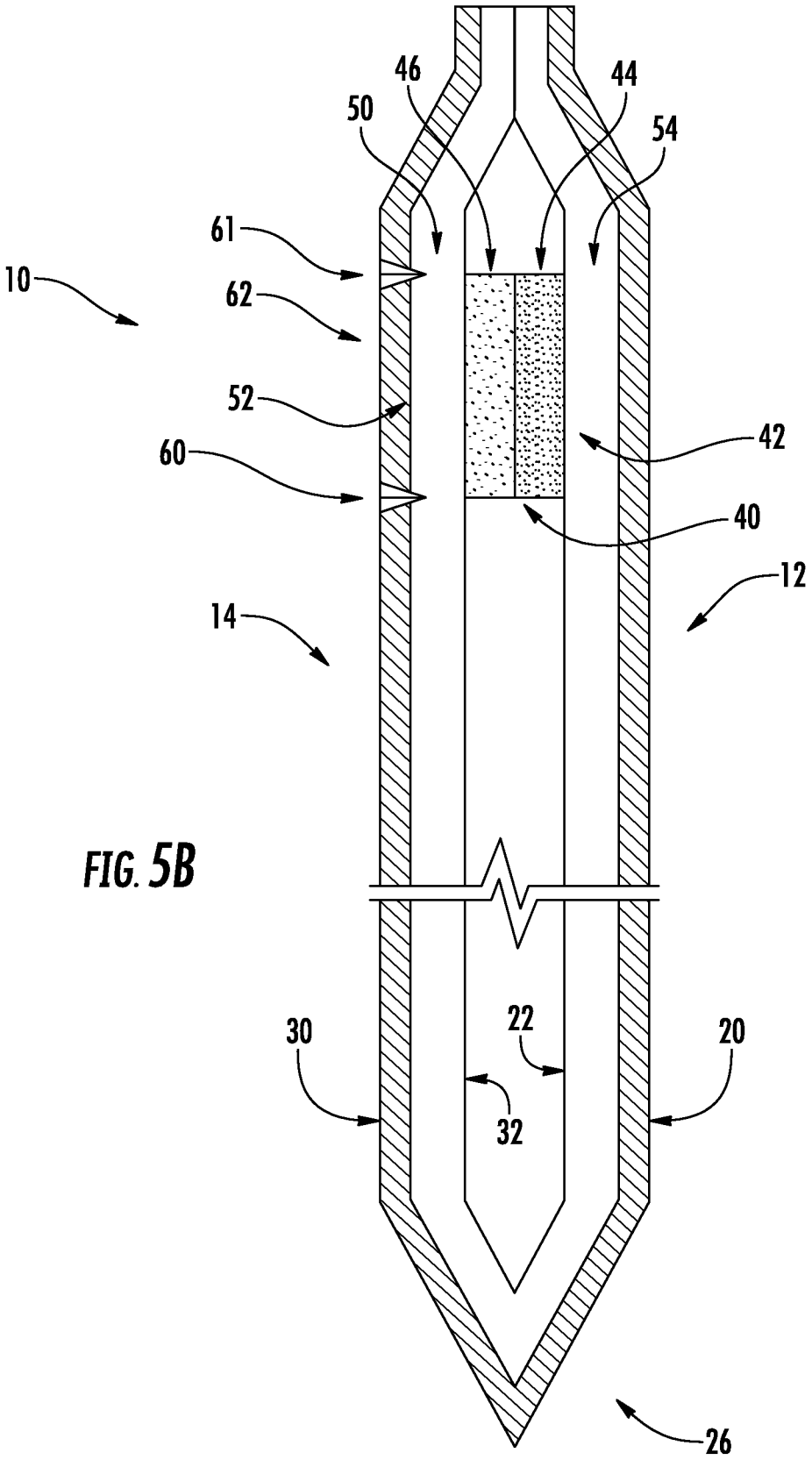
FIG. 5B is an enlarged schematic cross-sectional view of the package of FIG. 5A in a closed configuration according to another example embodiment of the invention.

With reference now to FIGS. 5A and 5B, in some embodiments, the removable flap portion 62 may be defined by a lower line of weakness 60 and an upper line of weakness 61. Thus, rather than being bounded at a lower boundary by the line of weakness 60 and at an upper boundary by the top edge 34 of the second panel 14, as in the embodiment depicted in FIGS. 1A-4B, the removable flap portion 62 in the embodiment depicted in FIGS. 5A and 5B is bounded at a lower boundary by the lower line of weakness 60 and at an upper boundary by the upper line of weakness 61. The upper and lower lines of weakness 60, 61 may thus define a strip therebetween which serves as the removable flap portion 62, as shown. In this regard, the permanent seal between the first and second panels 12, 14 may extend past the first and second regions 42, 52, towards a top edge region 80. Thus, in some cases as shown in FIGS. 5A and 5B, the permanent seal may extend from the top edges 24, 34 to the lower line of weakness 60, forming an expanded permanent seal area. As noted above with respect to the embodiment of FIGS. 1A-4B, the lines of weakness 60, 61 may be laser score lines that extends partially through a thickness of the second panel 14 or perforations that extend from the outer surface 30 of the second panel 14 to the inner surface 32 of the second panel.

Figure 6A:
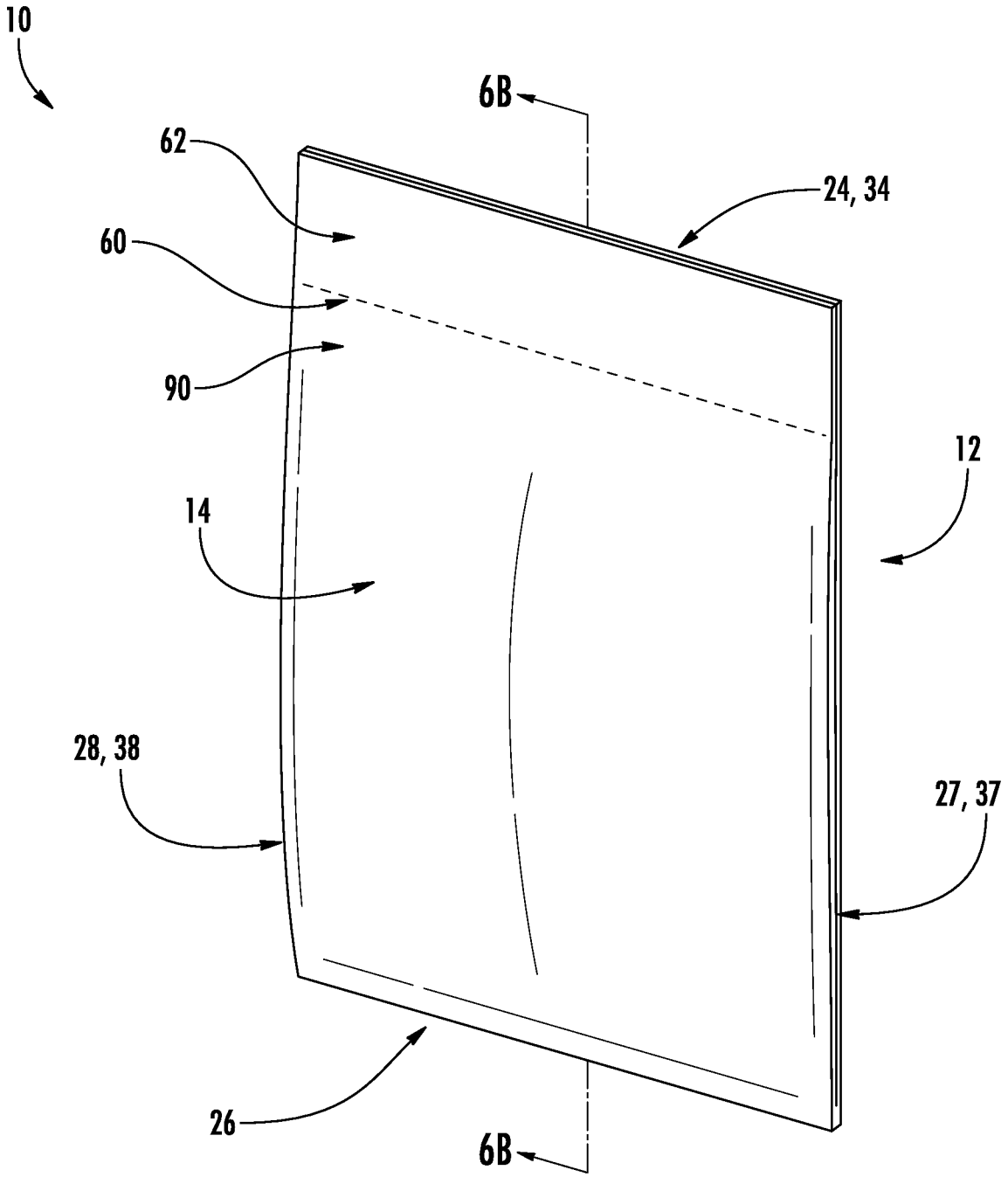
FIG. 6A is a perspective view of a package in a closed configuration according to another example embodiment of the invention including an inner reseal area.
Figure 6B:
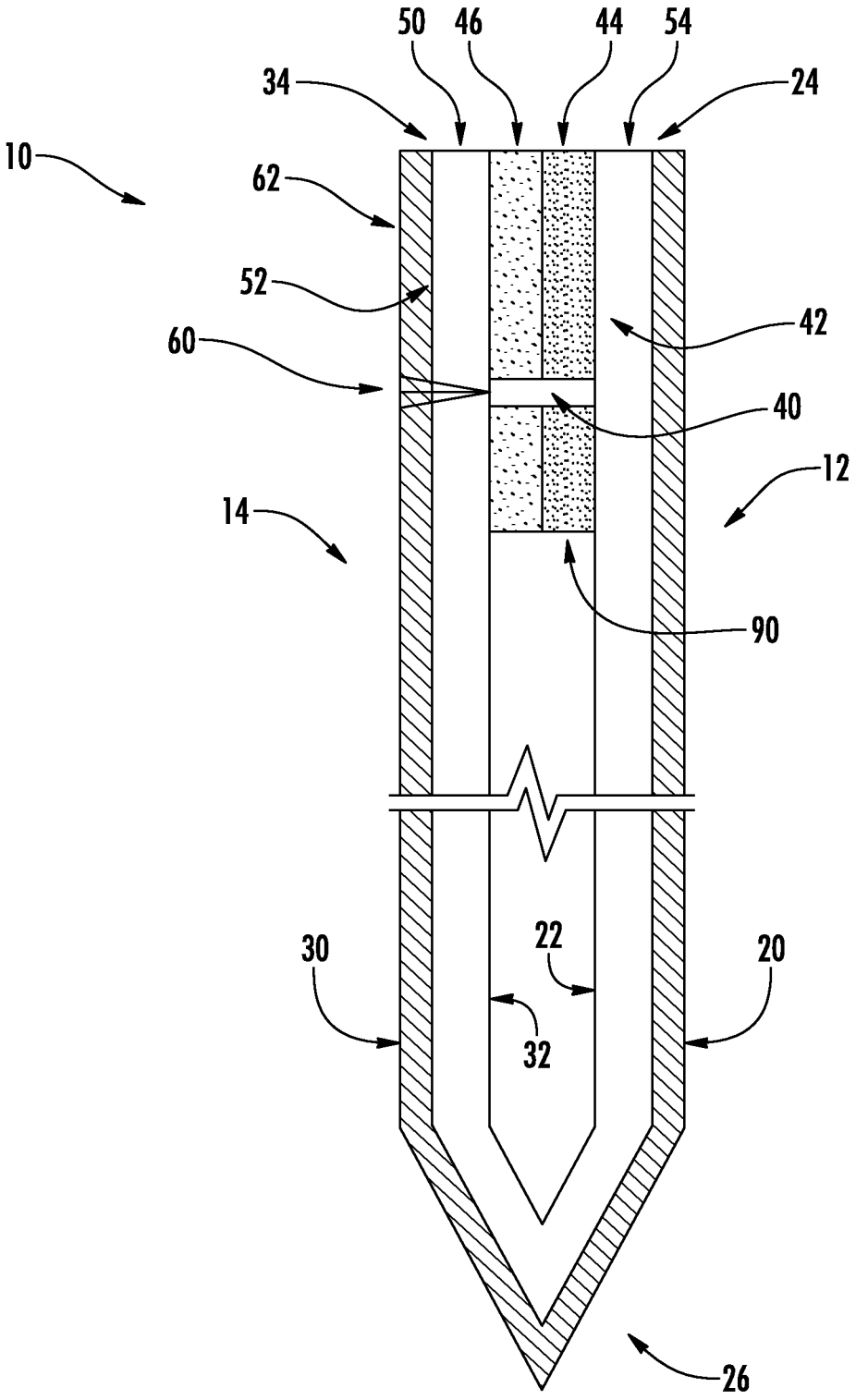
FIG. 6B is an enlarged schematic cross-sectional view of the package of FIG. 6A in a closed configuration according to an example embodiment of the invention including an inner reseal area.

Turning now to FIGS. 6A and 6B, and as noted above, in some embodiments the at least one line of weakness 60 may comprise a perforation that extends from the outer surface 30 of the second panel 14 to the inner surface 32 of the second panel 14. Although in FIGS. 6A and 6B a single line of weakness 60 is shown that includes a perforation extending through to the inner surface 32 of the second panel 14, in some cases the embodiment of FIGS. 5A and 5B including two lines of weakness 60, 61 is configured such that one or both lines of weakness extend through to the inner surface 32 of the second panel 14. In any of such cases, because the perforation of the line of weakness 60 extends all the way through the thickness of the second panel 14, the compartment formed between the first and second panels 12, 14 (and, thus, the product held within the compartment) may therefore be exposed to the environment outside the package 10. In other words, the existence of such perforations, as opposed to score lines formed only partially through the thickness of the second panel 14, create a pathway for oxygen and/or moisture to enter the package 10.

Accordingly, in such embodiments, the package 10 may further comprise an inner reseal area 90 defined on at least one of the inner surface 22 of the first panel 12 or the inner surface 32 of the second panel 14, between the folded bottom edge 26 of the panels 12, 14 and a location of the at least one line of weakness 60, as shown. In this way, the inner reseal area 90, when sealed (e.g., when engaged with the opposing panel to create an inner area of contact between the inner surfaces 22, 32 of the first and second panels 12, 14), is configured to maintain an integrity of the package interior prior to peeling of the removable flap portion 62. Moreover, once the package 10 has been opened by peeling away the removable flap portion 62, the inner reseal area 90 may engage the two opposing panels 12, 14 to create a second area of resealing, such as when the consumer presses the two panels together from the outside of the package, either before or after moving the resealing flap portion 72 into engagement with the outer surface of the opposing panel as shown in FIGS. 4A and 4B. In this regard, in some cases, the inner reseal area 90 may comprise at least one strip of PSA covered by PE and applied to the inner surface 22, 32 of the first or second panels 12, 14, so as to allow for resealing as described above. In still other cases, not shown, a strip of PE alone may be applied to the inner surface 22, 32 of the first or second panels 12, 14, thereby forming a peel seal that maintains the integrity of the contents until the package is first opened, but is not resealable.

In any of the embodiments described above, including the embodiments depicted in FIGS. 1A/1B, 5A/5B, and 6A/6B, peeling of the removable flap portion 62 may be facilitated by creating a deadened edge extending from the side edges 27, 28 and/or the opposite side edges 37, 38 partially inward from the respective edge in the heat seal region. In this way, the first and second panels 12, 14 are not heat sealed to each other in the location of the deadened edge, and the user may use this portion of the edge as a pull tab to initiate peeling of the removable flap portion 62. Pattern seal jaws may be used in some cases to create the deadened edge.

Figure 7:
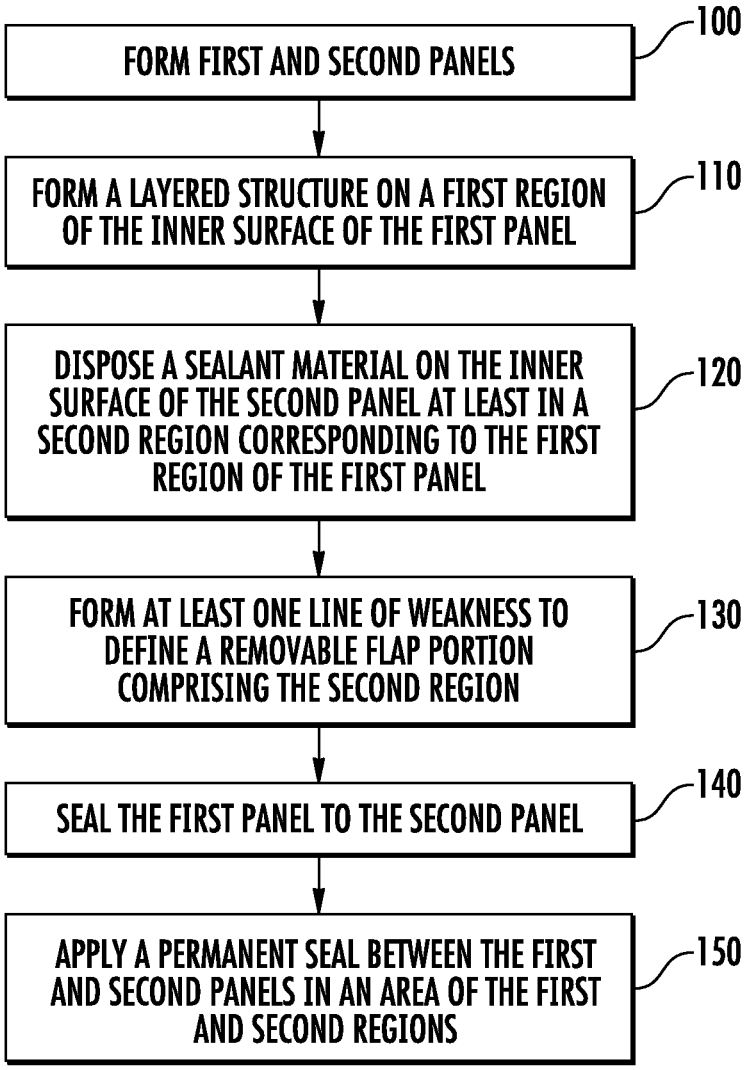
FIG. 7 is a schematic block diagram illustrating a method of manufacturing a package according to embodiments of the invention.

Embodiments of the package 10 described above may be made in various ways. With reference to FIG. 7, in some embodiments, for example, a package may be made by providing first and second panels, each having an outer surface and an opposite, product-facing inner surface. Block 100. The first panel may be defined between a top edge and an opposite folded bottom edge each extending in a transverse direction, and two opposing side edges each extending in a perpendicular longitudinal direction, between the top and bottom edges. Similarly, the second panel may be defined between a top edge and the opposite folded bottom edge each extending in a transverse direction, and two opposing side edges each extending in a perpendicular longitudinal direction, between the top and bottom edges.

A layered structure may be formed on a first region of the inner surface of the first panel proximate the top edge thereof and extending substantially from one of the side edges to the other of the side edges. Block 110. As described above, the layered structure may comprise a pressure-sensitive adhesive (PSA) disposed on the first region of the first panel, and a non-tacky sealant coating disposed over and covering the PSA such that the PSA is not exposed as long as the sealant coating is in place.

A sealant material may be disposed on the inner surface of the second panel at least in a second region corresponding to the first region of the first panel. Block 120. At least one line of weakness may be formed, such that the line(s) of weakness define a removable flap portion comprising the second region. Block 130. The first panel may then be sealed to the second panel using a horizontal form-fill-seal (HFFS) or a vertical form-fill-seal (VFFS) process in some cases, such that the first panel and the second panel are disposed with respective inner surfaces facing each other and the respective side and top edges being substantially aligned. Block 140. Side seals may be formed along at least the two pairs of opposing side edges of the first and second panels, such that a product placed between the first and second panels is enveloped thereby and the second region of the second panel overlies the first region of the first panel. Moreover, a permanent seal may be applied between the first and second panels in an area of the first and second regions, wherein the permanent seal has a bond strength exceeding that existing between the sealant coating and the PSA, such that peeling back the removable flap portion causes the sealant coating to be lifted from the PSA and thereby exposes the PSA, creating a resealing flap portion of the first panel that is configured to be folded over a new top edge of the second panel for resealing the package, as described above. Block 150.

For example, in some cases, the first panel 12 can be produced from a coextruded web of material, which may be subsequently surface-printed to apply the PSA 44 and sealant coating 46 all on the same side of the web, and to form the line of weakness 62, for each package length of the web. Likewise, the sealant material 50 may be surface-printed onto the inner surface of the second panel. As noted above, for example, the sealant coating may comprise a polyethylene (PE) emulsion.

Forming the at least one line of weakness to define the removable flap portion may, in some embodiments, comprise forming a lower line of weakness and an upper line of weakness, and the removable flap portion may be defined between the lower line of weakness and the upper line of weakness, as described above. In some cases, forming the at least one line of weakness to define the removable flap portion may comprise laser scoring the second panel to form a laser score line that extends partially through a thickness of the second panel. In still other cases, the step of forming the at least one line of weakness to define the removable flap portion may comprise creating a perforation that extends from the outer surface of the second panel to the inner surface of the second panel.

In some embodiments, such as shown and described above in connection with FIGS. 6A and 6B, the method may further include defining an inner reseal area on at least one of the inner surface of the first panel or the inner surface of the second panel between the folded bottom edge and a location of the at least one line of weakness. In cases where the lines of weakness are perforations that extend through the entire thickness of the second panel, which might otherwise allow moisture and oxygen from the package environment to ingress, the inner reseal area (when sealed) may be able to maintain an integrity of the package interior prior to peeling of the removable flap portion. The inner reseal area may, in some cases, comprise applying at least one strip of PSA covered by PE or applying a strip of PE alone (e.g., to create a peel seal) to at least one of the inner surface of the first panel or the inner surface of the second panel.

As described above, the first and second panels may be made from a single folded sheet and may comprise a mono-web, olefin-based film. The first and second panels may, in some cases, comprise a barrier layer. Moreover, an area of separation may be created between the first panel and the second panel along opposing side edges of at least one of the pairs of opposing side edges in a location of the removable flap portion to facilitate peeling of the removable flap portion. For example, the area of separation may be created using a pattern heat seal tool.

Embodiments of the package and method described above provide mono-web olefin-based films that will tear in a linear fashion due to the perforations or scoring patterns, compensating for the typical loss of directionality that is experienced by laminations due to the PET or OPP directionality. For example, the methods described are thus configured to provide a multi-faceted packaging film in which various liquid coatings are used to create surfaces that are heat resistant (e.g., using cross-linked overlaquers); are barriers to oxygen and/or moisture; are heat sealable and/or have high bond strengths (e.g., due to the selected film); are peelable or have lower bond strengths (e.g., due to the sealant coating); and/or are resealable or reclosable (e.g., due to the layered structure having PSA and the sealant coating). In addition, embodiments of the package described herein may be produced through one pass in a gravure press and may allow for two-sided printing of the package. As a result of the features described above, thinner gauge webs of materials may be used to create packages, which may result in more impressions on the roll, such that more packages may be produced from a single roll of material at a given diameter.

The resulting package therefore provides a container for storing content that is more easily reclosable (e.g., as compared to a package having a press-to-close zipper). Moreover, in embodiments such as shown in FIGS. 6A and 6B, the dual reseal areas (e.g., via the resealing flap portion and the inner reseal area) should reduce "spring back" of the resealing flap portion when it is engaged with the outer surface of the second panel, thereby allowing the package to stay closed. In this way, the contents may safely be held in the package, and a consumer may perceive that the product remains fresher for a longer time due to the presence of a "dual freshness seal." Finally, the "peel away" configuration of the removable flap portion may further provide the consumer with tamper evidence for the package.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of making a package from a sheet of material comprising:

forming a first panel having an outer surface and an opposite, product-facing inner surface, the first panel extending between a top edge and an opposite folded bottom edge each extending in a transverse direction, and two opposing side edges each extending in a perpendicular longitudinal direction, between the top and bottom edges;

forming a second panel having an outer surface and an opposite, product-facing inner surface, the second panel extending between a top edge and the opposite folded bottom edge each extending in a transverse direction, and two opposing side edges each extending in a perpendicular longitudinal direction, between the top and bottom edges;

forming a layered structure on a first region of the inner surface of the first panel proximate the top edge thereof and extending substantially from one of the side edges to the other of the side edges, the layered structure comprising a pressure-sensitive adhesive (PSA) disposed on the first region of the first panel, and a non-tacky sealant coating selected from the group consisting of polyethylene (PE) emulsion, acrylic, urethane, and ethyl vinyl acetate, disposed over and covering the PSA such that the PSA is not exposed as long as the sealant coating is in place;

disposing a scalant material selected from the group consisting of polypropylene, polyethlene (HDPE, LDPE, LLDPE), polyethylene terephthalate, and nylon, on the iner surface of the first panel, directly adjhacent the PSA, at least in the first region and covers an area that is larger than the area on which the PSA and the sealant coating are disposed and wherein the sealant material is permanently sealed to the PSA, disposing a sealant material selected form the group consisting of polypropylene, polyethylene (HDPE, LDPE, LLDPE), polyethylene terephthalate, and nylon, on the inner surface of the second panel at least in a second region corresponding to the first region of the first panel and the sealant material is permanently sealed to the sealant coating, forming at least one line of weakness to define a removeable flap portion which is continuous with the top edge of the second panel, extend substantially form one of the side edges to the othere of the side edges, and comprises the second region and overlies the first region of the first panel;

sealing the first panel to the second panel, such that the first panel and the second panel are disposed with respective inner surfaces facing each other and the respective side and top edges being substantially aligned, wherein side seals are formed along at least the two pairs of opposing side edges of the first and second panels, such that a product placed between the first and second panels is enveloped thereby and the second region of the second panel overlies the first region of the first panel;

defining an inner reseal area on at least one of the inner surface of the first panel or the inner surface of the second panel between the folded bottom edge and a location of the at least one line of weakness, wherein the inner reseal area comprises at least one strip of PSA covered by polyethylene; and selecting the sealant coating such that the permanent seal between the sealant material and the sealant coating in an area of the first and second regions has a bond strenght exceeding that existing between the sealant coating and the PSA, such that peeling back the removable flap portion causes the sealant coating to be lifted from the PSA and thereby exposes the PSA, creating a resealing flap portioin of the first panel that is configured to be folded over a new top edge of the second panel for resealing the package.

2. The method of claim 1, wherein the sealant coating comprises a polyethylene (PE) emulsion.

3. The method of claim 1, wherein forming the at least one line of weakness to define the removable flap portion comprises laser scoring the second panel to form a laser score line that extends partially through a thickness of the second panel.

4. The method of claim 1, wherein forming the at least one line of weakness to define the removable flap portion comprises creating a perforation that extends from the outer surface of the second panel to the inner surface of the second panel.

5. The method of claim 4 wherein the inner reseal area, when sealed, is configured to maintain an integrity of the package interior prior to peeling of the removable flap portion.

6. The method of claim 1, wherein at least one of the first or second panels comprises a mono-web, olefin-based film.

7. The method of claim 1, wherein the first and second panels comprise a barrier layer.

8. The method of claim 1 further comprising creating an area of separation between the first panel and the second panel along opposing side edges of at least one of the pairs of opposing side edges in a location of the removable flap portion to facilitate peeling of the removable flap portion.

9. The method of claim 8, wherein the area of separation is created using a pattern heat seal tool.

10. A package for holding a product, comprising:

a sheet of material, wherein the sheet defines:

a first panel having an outer surface and an opposite, product-facing inner surface, the first panel extending between a top edge and a folded edge forming an opposite bottom edge each extending in a transverse direction, and two opposing side edges each extending in a perpendicular longitudinal direction, between the top and bottom edges; and a second panel having an outer surface and an opposite, product-facing inner surface, the second panel extending between a top edge and the folded edge forming an opposite bottom edge each extending in a transverse direction, and two opposing side edges each extending in a perpendicular longitudinal direction, between the top and bottom edges; and a layered structure formed on a first region of the inner surface of the first panel proximate the top edge thereof and extending substantially from one of the side edges to the other of the side edges, the layered structure comprising a pressure-sensitive adhesive (PSA) disposed on the first region of the first panel, and a non-tacky sealant coating selected from the group consisting of polyethylene (PE) emulsion, acrylic, urethane, and ethyl vinyl acetate, wherein the sealant coating is disposed over and covering the PSA such that the PSA is not exposed as long as the sealant coating is in place;

wherein the first panel and the second panel are disposed such that the respective inner surfaces face each other and the respective side and top edges are substantially aligned, wherein side seals are formed along at least the two pairs of opposing side edges of the first and second panels, such that a product placed between the first and second panels is enveloped thereby, wherein the first panel comprises a sealant material selected form the group consisting of polypropylene, polyethylene (HDPE, LDPE, LLDPE), polyethylene terephthalate, and nylon, wherein the sealant material is disposed on the inner surface of the first panel at least in the first region and covers an area that is larger that the area on which the PSA and the sealant coating are disposed and wherein the sealant material is permanently sealed to the PSA, wherein the sealant material disposed on the inner surface of the first panel is directly adjacent the PSA, wherein the second panel comprises a sealant material selected from the group consisting of polypropylene, polyethylene (HDPE, LDPE, LLDPE), polyethylene terephthalate, and nylon, wherein the sealant material is disposed on the inner surface of the second panel at least in a second region correspoinding to the first region of the first panel and the sealant material is pernamently sealed to the sealant coating, wherein the second panel further comprises at least one line of weakness comprising a perforation that etends from the outer surface of the second panel to the inner surface of the second panel, defining a removable flap portion which is continuous with the top edge of the second panel, extends substantially from one of the side edges to the other of the side edges, and comprises the second region and overlies the first region of the first panel, wherein the sealant coating is selected such that the permanent seal between the sealant material and the sealant coating in an area of the first and second regions has a bond strength exceeding that existing between the sealant coating and the PSA, such that peeling back the removable flap portion causes the sealant coating to be separated from the PSA, and thereby exposes the PSA, creating a resealing flap portion of the first panel that is configured to be folded over and adhered to the second panel for resealing the package, and an inner reseal area defined on at least one of the inner surface of the first panel or the inner surface of the second panel between the folded bottom edge and a location of the at least one line of weakness, wherein the inner reseal area comprises at least one strip of PSA covered by polyethylene.

11. A package for holding a product, comprising:

a sheet of material, wherein the sheet defines:

a first panel having an outer surface and an opposite, product-facing inner surface, the first panel extending between a top edge and a folded edge forming an opposite bottom edge each extending in a transverse direction, and two opposing side edges each extending in a perpendicular longitudinal direction, between the top and bottom edges; and a second panel having an outer surface and an opposite, product-facing inner surface, the second panel extending between a top edge and the folded edge forming an oppostie bottom edge each extending in a transverse direction, and two opposing side edges each extending in a perpendicular longitudinal direction, between the top and bottom edges; and a layered structure formed on a first region of the inner surface of the first panel proximate the top edge thereof and extending substantially from one of the side edges to the other of the side edges, the layered structure comprising a pressure-sensitive adhesive (PSA) disposed on the first region of the first panel, and a non-tacky sealant coating selected from the group consisting of polyethylene (PE) emulsion, acrylic, urethane, and ethyl vinyl acetate, wherein the sealant coating is disposed over and covering the PSA such that the PSA is not exposed as long as the sealant coating is in place;

wherein the first panel and the second panel are disposed such that the respective inner surfaces face each other and the respective side and top edges are substantially aligned, wherein side seals are formed along at least the two pairs of opposing side edges of the first and second panels, such that a product placed between the first and second panels is enveloped thereby, wherein the first panel comprises a sealant material selected from the group consisting of polypropylene, polyethylene (HDPE, LDPE, LLDPE), polyethylene terephthalate, and nylon, wherein the sealant material is disposed on the inner surface of the first panel at least in the first region and covers an area that is larger than the area on which the PSA and the sealant coating is disposed and wherein the sealant material is pernamently sealed to the PSA, wherein the sealant material disposed on the inner surface of the first panel is in direct contact with the PSA, wherein the second panel comprises a sealant material selected from the group consisting of polypropylene, polyethylene, (HDPE, LDPE, LLDPE), polyethylene terephthalate, and nylon, wherein the sealant material is disposed on the inner surface of the secnd panel at least in a second region corresponding to the first region of the first panel and the sealant material is permanently sealed to the sealant coating, wherein the second panel further comprises at least one line of weakness comprising a perforation that extends from the outer surface of the second panel to the inner surface of the second panel, defining a removable flap portion which is continuous with the top edge of the second panel, extends substantially from one of the dise edges to the other of the side edges, and comprises the second region and overlies the first region of the first panel, wherein the sealant coating is selected such that the permanent seal between the sealant material and the sealant coating in an area of the first and second regions has a bond strength exceeding that existing between the sealant coating and the PSA, such that peeling back the removable flap portion causes the sealant coating to be separated from the PSA, and thereby exposes the PSA, creating a resealing flap portion of the first panel that is configured to be folded over and adhered to the secoond panel for resealing the package, and an inner reseal area defined on at least on of the inner surface of the first panel or the inner surface of the second panel between the folded bottom edge and a location of the at least one line of weakness, wherein the inner reseal area comprises at least one strip of PSA covered by polyethylene.

12. The package of claim 10 or 11, wherein at least one of the first or second panels comprises a mono-web, olefin-based film.

13. The package of claim 10 or 11, wherein the first and second panels comprise a barrier layer.

14. The package of claim 10 or 11 wherein the first panel and the second panel comprise polyethylene terephthalate, the sealant material comprises polyethylene, and the sealant coating comprises a polyethylene emulsion.

15. The package of claim 10 or 11 additionally comprising an area of separation between the first panel and the second panel in a location of the removable flap portion to facilitate peeling of the removable flap portion.

16. The package of claim 10 or 11 wherein the layered structure is bounded at an upper boundary by the top edge of the first panel.

* * * * *